US012722822B2

(12) United States Patent
Wittmann et al.

(10) Patent No.: US 12,722,822 B2
(45) Date of Patent: Sep. 1, 2026

(54) PACKAGING APPARATUS AND METHOD FOR APPLYING PACKAGING TO AN ARTICLE COMBINATION

(71) Applicant: Krones Aktiengesellschaft, Neutraubling (DE)

(72) Inventors: Stephan Wittmann, Siegsdorf (DE); Herbert Spindler, Niedermoosen (DE); Marcus Kreis, Kolbermoor (DE)

(73) Assignee: Krones Aktiengesellschaft, Neutraubling (DE)

( * ) Notice: Subject to any disclaimer, the term of this patent is extended or adjusted under 35 U.S.C. 154(b) by 0 days.

(21) Appl. No.: 18/859,333

(22) PCT Filed: Feb. 23, 2023

(86) PCT No.: PCT/EP2023/053475
§ 371 (c)(1),
(2) Date: Oct. 23, 2024

(87) PCT Pub. No.: WO2023/208434
PCT Pub. Date: Nov. 2, 2023

(65) Prior Publication Data

US 2025/0289602 A1 Sep. 18, 2025

(30) Foreign Application Priority Data

Apr. 27, 2022 (DE) ..... 10 2022 110 257.2

(51) Int. Cl.
*B65B 43/10* (2006.01)
*B65B 17/02* (2006.01)

(52) U.S. Cl.
CPC ..... *B65B 17/025* (2013.01); *B65B 43/10* (2013.01)

(58) Field of Classification Search
USPC ..... 53/398
See application file for complete search history.

(56) References Cited

U.S. PATENT DOCUMENTS 4,641,483 A * 2/1987 Yamauchi ..... B65B 17/025 53/48.5
2020/0189821 A1 6/2020 Smalley
(Continued)

FOREIGN PATENT DOCUMENTS

DE 20314088 U1 * 1/2004 ..... B65D 71/48
DE 102022115413 A1 * 12/2023 ..... B65B 17/025
(Continued)

OTHER PUBLICATIONS

PCT Application: PCT/EP2023/053475 Filed Feb. 13, 2023—International Preliminary Report on Patentability dated Nov. 7, 2024.

(Continued)

*Primary Examiner* — Chinyere J Rushing-Tucker
(74) *Attorney, Agent, or Firm* — Simmons Perrine PLC

(57) ABSTRACT

A packaging apparatus and a method for applying packaging (20) to an article combination (30) comprising at least two articles in each instance. The packaging apparatus comprises at least one preparation die for preparing the packaging (20). The preparation die (40) comprises a folding device for folding over opposite edge regions (23) of a packaging blank (21) that forms the packaging (20). The packaging apparatus further comprises an application die for receiving the prepared packaging blank (21*v*) and for applying said blank to the article combination (30), so that the packaging (20) applied to the articles is disposed at least in part between the articles, wherein the packaging (20) applied to the articles at least partially surrounds outer lateral surfaces (36) of the article combination (30).

19 Claims, 6 Drawing Sheets

(56) References Cited

U.S. PATENT DOCUMENTS

| | | | | |
|---|---|---|---|---|
| 2022/0348368 | A1* | 11/2022 | Frederick | B65B 17/025 |
| 2023/0257177 | A1* | 8/2023 | Aneiros | B65D 71/42 206/149 |

FOREIGN PATENT DOCUMENTS

| | | | |
|---|---|---|---|
| EP | 1340691 | A1 | 9/2003 |
| GB | 2170774 | A | 8/1986 |
| WO | 2022011109 | A1 | 1/2022 |

OTHER PUBLICATIONS

PCT Application: PCT/EP2023/053475 Filed: Feb. 13, 2023—International Search Report dated Jun. 16, 2023.
Priority Application: DE 10 2022 110 257.2 Filed: Apr. 27, 2022—German Search Report dated Jan. 10, 2023.

* cited by examiner

PACKAGING APPARATUS AND METHOD FOR APPLYING PACKAGING TO AN ARTICLE COMBINATION

CLAIM OF PRIORITY

The present application claims priority to International Application PCT/EP2023/053475, filed Feb. 13, 2023, which in turn claims priority to German Application DE 10 2022 110 257.2, filed Apr. 27, 2022, which are incorporated by reference.

FIELD OF THE INVENTION

The present invention relates to a packaging apparatus and to a method for applying packaging to article combinations.

BACKGROUND OF THE INVENTION

In the field of packaging technology, it is known to provide so-called top-gripping carton packages for carrying a plurality of articles. Such grip carton packaging is well known in the art and is particularly useful for allowing consumers to transport, store and access a group of items.

For cost reasons and for reasons of environmental protection and resource conservation, such grip cardboard packaging should use as little material as possible, i.e., consist of as little material as possible, but still meet the necessary requirements for resistance, mechanical stability and article cohesion. Important points here are the strength and toughness of the cardboard material used and its suitability for holding and transporting large weights of sometimes heavy items. In addition, a secure mechanical cohesion of the items is important.

Top-gripping object carriers are known with which openings are provided in a plate of the carrier for receiving and gripping the articles. Often, the arrangement of a plurality of items is disposed in at least two rows. Furthermore, a handle structure is often provided for carrying. Such an article carrier is described, for example, in unexamined published patent application WO 2022/011 109 A1.

In view of the known article carriers, it can be considered the primary object of the invention to make the application of top-gripping cardboard packaging to articles more efficient, in order to be able to produce stable article combinations or gripping cardboard bundles in this way.

SUMMARY OF THE INVENTION

The above object is achieved by a packaging apparatus and a method for applying packaging to an article combination, which comprise the features of the independent claims. Further advantageous embodiments are described by the dependent claims.

The method provides that the packaging applied to the articles of an article combination is at least partially pushed between adjacent articles and thus at least partially disposed between the articles, and wherein the packaging applied to the articles at least partially surrounds outer lateral surfaces of the article combination.

The articles to be combined are preferably containers filled with a liquid content, for example bottles or cans, in particular beverage containers. However, the bottles or cans or similar containers can also be filled for example with fluid or pasty cosmetics, such as shampoo or the like.

Therefore, when in the present context we speak generally of articles or article combinations, this can in particular refer to so-called primary packaging such as containers, cans, bottles, etc., which have a content that can be quantified in terms of weight and/or volume, for example a certain volume of liquid. These articles or this primary packaging are combined and mechanically held together by a packaging material acting as secondary packaging in the manner described below, such that bundles consisting of a plurality of articles are formed or will be formed.

The packaging or secondary packaging referred to here is formed in particular by packaging blanks. These can in each instance preferably consist of a paper or cardboard material, a plastics material, a cardboard/plastics composite material, or the like.

Each of the packaging blanks in each instance has passage openings for the articles to be combined by the packaging blank, wherein these passage openings correspond to the longitudinal center axes of the articles to be combined and partially receive the articles, either by producing a positive-locking connection and/or, alternatively, by producing a locking connection that can be released by applying a tensile force or release force.

With the method described here, the packaging is prepared by folding at least two opposing edge regions of a packaging blank forming the packaging approximately 90 degrees in each instance. In particular, all four edge regions or edge sections of a substantially rectangular packaging blank are folded over approximately 90 degrees in each instance.

It can be provided that the packaging means or the packaging blank provides corresponding folding edges which facilitate the process of folding the lateral edge regions. In this case, the packaging or the packaging blank is sensibly dimensioned in such a way that a main surface covers the article combination on the top, wherein the articles can protrude into the passage openings and/or be locked into them, while the folding edges correspond approximately to the lateral outlines of the article combination. In this way, the edge regions can be bent at the fold edges and placed on the side surfaces of the article combination.

The packaging blank prepared in this way is now applied to the article combination by a downward movement. When a downward movement is mentioned in this context and in the overall context of the present description, this takes into account the fact that the articles of the article combination during their handling and during the application of the packaging blank normally stand upright on their lower end faces on a base, such as a support surface or a conveyor surface of a horizontal conveyor device, while their upper end faces are accessible for the application of the packaging blank.

In this position and orientation of the articles and the article combination, a downward movement of the packaging blank, i.e., in the direction of the upper end faces of the articles, almost inevitably results if it is to be applied to the article combination.

Accordingly, in the present context one can generally speak of a downward movement of the packaging blank, which, however, should not exclude the possibility that the articles can also be moved or held in a lying or inclined position, so that the packaging blank would not necessarily have to be moved downward when applied to the front sides of the articles. However, because such a positioning of the articles in the article combination is not the rule but the exception, the above formulation (downward movement)

should be retained but should be understood as a synonym for a movement in the direction of the freely accessible front sides of the articles in the article combination.

As part of the described method, the packaging blank is in each instance applied to the articles in such a way that the articles partially pass through the passage openings of the packaging blank and are thus held together by the packaging blank. In particular, the packaging blank is locked to the articles in this way, wherein these locking connections can be released by applying a tensile force, possibly destroying or damaging the packaging blank if individual articles are to be released from the article cohesion and removed from it.

For this purpose, the passage openings of the packaging blank can each have suitable fixing apparatuses that can be formed, for example, by fixing tabs. For example, fixing tabs are formed by notches or the like extending radially inward toward the passage opening center point.

Particularly preferably, the packaging blank is in each instance secured to articles in such a way that the articles are each held in a clamping manner within a passage opening of the packaging blank in the region of an upper taper. In particular, bottles are held in a clamping manner below a so-called neck ring and cans are held in a clamping manner below a flanged edge forming the can edge, whereby an effective interlocking between the packaging blank and the articles is given in each instance.

Furthermore, within the scope of the described method, it is provided that the folded edge regions of the packaging blank at least partially surround lateral outer surfaces of the articles and thus also the article combination. The folded edge regions of the packaging blank form for example a collar around an upper region of the outer casing surfaces of the articles.

A packaging apparatus by which a method described above can be carried out comprises at least one preparation die for preparing the packaging, which preparation die comprises at least one folding device which is configured to fold at least two opposing edge regions of a packaging blank forming the packaging approximately 90 degrees, in particular the edge regions are folded downward.

However, it may also be useful to fold the edge regions to a fold angle of less than 90 degrees in preparation for the packaging blank and to only create the final fold angle of approximately 90 degrees when applying or after applying the packaging blank to the article combination.

Furthermore, the packaging apparatus comprises at least one application die, which is configured to receive the packaging prepared by folding over the edge regions and to apply it to a prepared article combination comprising at least two articles by a downward movement or by a movement directed at freely accessible front sides of the articles, so that the packaging applied to the articles is disposed at least in part between the articles or between adjacent articles, and so that the packaging applied to the articles at least partially surrounds outer lateral surfaces of the article combination, in particular wherein the folded-over edge regions of the packaging at least partially encompass or surround outer lateral surfaces of the article combination.

Furthermore, it can be provided that in the course of preparing the packaging blank for application to the articles, additional preparation of the passage openings of the packaging blank is provided, for example at least a slight pre-breaking or pre-expanding of the passage openings, in order to at least slightly reduce the mechanical resistance when placing and locking the articles in the passage openings.

For example, an upwardly directed pre-folding of the fixing devices or fixing elements assigned to the passage openings can be provided, wherein the same applies with regard to the the direction of movement (upwardly directed pre-folding) as with regard to the downwardly directed application direction of the packaging blank on the article combination. Substantially, the direction "upward" refers to the direction opposite from the application movement, because this is also the direction of movement of the articles in each instance penetrating the passage openings.

For this purpose, it can be provided that the preparation die comprises corresponding devices for preparing the passage openings of the packaging blank, in particular that the preparation die comprises an upper die having at least one receiving device or holding device for the packaging blank and that the preparation die comprises a lower die having a plurality of expansion tools.

The receiving device or holding device can be formed, for example, by a retaining pin or holding pin which engages in a suitable receiving opening of the packaging blank. Alternatively, the upper die can also be equipped with a suction device, for example, in order to securely grasp and hold the packaging blank. The advantage of such a suction device is its controllable activation and deactivation capability, so that the packaging blank can be grasped, held and, as needed In the following, an embodiment of a preparation die is described which is configured for folding the edge region of the packaging blank and for widening the passage openings of the packaging blank.

The lower die of the preparation die preferably comprises an arrangement of expansion tools, which are also referred to below as expansion cones. The number and arrangement of the expansion tools corresponds to the number and arrangement of the passage openings in the packaging blank.

The upper die with the packaging blank disposed thereon is placed on the lower die, so that the expansion tools at least partially pass through the passage openings of the packaging blank. Due to a cross-sectional region of the expansion tools which is widened at the bottom, the edge regions of the passage openings are pre-broken and formed based on the shape predefined by the expansion tools.

If the passage openings have fixing devices in the form of fixing tabs, the fixing tabs are pre-broken by the expansion tools at the notches and can also be folded upward at least slightly.

Preferably, the packaging blank is pressed down by the upper die until it stops against the expansion tools of the lower die.

The corner regions of the lower die can also form a free-form surface for shaping the corners of the packaging blank to be formed between the foldable edge regions.

For a person skilled in the art, it is of course self-evident that the lower die can also be brought into operative connection with the upper die by an upward movement.

Now the edge regions of the packaging blank are folded over. For this purpose, the preparation die according to the embodiment described here further comprises a folding element. The folding element has lateral surfaces which are at least partially vertically aligned and also access openings for sub-regions of the first upper die and/or guide receptacles for guide elements of the first upper die.

The folding element moves downward onto the so-called pre-breaking unit, which is formed from the upper die and the lower die. In this case, the lateral edge regions of the packaging blank disposed between the upper die and the lower die that protrude from the pre-breaking unit are folded downward by the side surfaces of the folding element. In particular, the edge regions are folded over approximately 90 degrees in each instance.

When bringing the folding element and the pre-breaking unit together, it is provided that the sub-regions of the first upper die engage through the access openings of the folding element and/or that guide elements of the first upper die engage in the guide receptacles of the folding element. This allows the folding element to be placed securely on the pre-breaking unit.

Following the positioning of the folding element on the pre-breaking unit, the connection between the receiving device of the upper die and the packaging blank prepared by pre-breaking and pre-folding is released and the folding element is moved upward together with the upper die.

For example, it can be provided that the upper die is grasped at the sub-regions that protrude upward and lifted upward, wherein the folding element that is in operative connection with the upper die via the access openings is also necessarily moved upward.

Alternatively, the lower die with the prepared packaging blank resting on it can be moved downward away from the upper die and the folding element.

The upper die, the lower die and the folding element thus form components of a possible embodiment of a preparation die for preparing the packaging, which preparation die comprises at least one folding device in the form of the folding element, which is configured to fold at least two opposing edge regions—in particular all four edge regions of a rectangular packaging blank forming the packaging—by 90 degrees.

According to one embodiment, it is provided that the preparation die is formed by an exchangeable format part or by a plurality of exchangeable format parts, which is/are exchanged during a production changeover, in particular during a product change. In particular in the case of a preparation die consisting of an upper die, a lower die and a folding element, these must be adapted to the number, composition, size and/or shape of the articles and the packaging blank used.

The application die grasps the packaging blank, which has been prepared at least by folding over the side edge regions, in order to apply it to the corresponding article combinations. For this purpose, the application die has a receptacle for the prepared packaging blank and is also equipped with corresponding receiving devices or holding devices for holding the prepared packaging blank.

One embodiment of the application die of the packaging apparatus has lateral boundary surfaces, against which lateral boundary surfaces the folded lateral edge regions of the prepared packaging blank rest and are held in their folded position during application to the articles.

The following describes the application of a packaging blank to an article combination, which packaging blank has been prepared by widening the passage openings and folding over the edge regions. A person skilled in the art can also apply the described principle to packaging blanks which have only been prepared by folding over the edge regions.

The prepared packaging blank can be removed from the lower die by a second upper die, in particular the prepared packaging blank is grasped by receiving devices of the second upper die, for example via hooks, suction cups or the like. The second upper die has lateral boundary surfaces which, after receiving the prepared packaging blank, protrude downward beyond the downwardly folded lateral edge regions of the prepared packaging blank, so that the folded lateral edge regions are completely covered by the lateral boundary surfaces. In particular, the lateral boundary surfaces ensure that the downwardly folded edge regions of the prepared packaging blank remain in the folded state.

The second upper die together with the grasped prepared packaging blank is applied to the article combination from above. The second upper die is placed above the article combination in such a way that the top sides of the articles pass through the passage openings of the prepared packaging blank.

If the articles are formed by cans, it is provided that the lid regions of the cans pass through the passage openings of the prepared packaging blank. In particular, the prepared packaging blank is fixed below the flanged edge of the cans by engaging the fixing tabs of the passage openings below the flanged edge of the cans. In particular, after the packaging blank has been secured to the cans, the lid region of the cans is located above the packaging blank, while the cylindrical can body is located below the packaging blank.

The laterally folded edge regions of the packaging blank surround the outer surfaces of the cylindrical can body below the flanged edge.

Due to the previously described arrangement and fastening of the packaging blank to the articles, a packaging unit is formed. With the packaging unit, the packaging blank is preferably in engagement with the articles in such a way that the packaging blank is secured to the articles in a substantially stationary manner and the articles can no longer make any significant relative movements or changes in position relative to one another and relative to the packaging blank. As a result, the packaging blank can be removed from the articles of the packaging unit again only by applying increased force with a force component directed upward, wherein the packaging blank is generally at least partially destroyed.

According to an alternative embodiment, it can be provided that the folding element comprises a type of cage or frame made of vertical guide elements or sheets, which, in addition to folding, take over the function of the lateral boundary surfaces of the second upper die of the application die. In this case, it is provided that the appropriately prepared packaging blank is removed directly from the lower die with the first upper die and the cage or frame and that the prepared packaging blank can now be disposed directly on the articles of the article combination.

A preferred embodiment of the method serves for the simultaneous application of at least two packaging materials to articles for the simultaneous formation of at least two packaging units, wherein the articles are fed directly adjacent to one another in an ordered mass flow.

An ordered mass flow is intended in particular to mean an ordered multi-row feed of articles, in particular a feed in which the articles are disposed in a plurality of rows parallel to the transport direction and in a plurality of rows perpendicular to the transport direction. Particularly preferably, the articles are conveyed in an ordered mass flow, end to end, i.e., touching one another.

For example, the items are moved via conveyor belts. An alternative embodiment can provide that the articles are pushed over a transfer plate by a push rod.

The mass flow can be limited on the outside by guide elements, such as lane separators. Furthermore, further guidance can also be provided within the mass flow by central guide elements in the form of central lane separators. In this case, it is preferably provided that in each instance a plurality of articles are combined to form a packaging unit between a central guide element and an outer guide element or between two central guide elements by packaging.

Alternatively, it can be provided that the articles are divided into groups in advance, with each group comprising a defined number of articles in a corresponding arrangement. For example, groups of 18, 24, 32 or the like can be provided. In the groups of 18, the items are disposed in three parallel, adjacent rows, wherein each row in each instance comprises six items disposed directly one behind the other. In the groups of 24, for example, the items are disposed in four parallel, adjacent rows of six items in each instance. In the groups of 32, for example, the items are disposed in four parallel, adjacent rows with eight items in each instance, etc.

A packaging apparatus equipped for this purpose comprises an application die having at least two receptacles disposed next to one another for prepared packaging blanks, wherein the application die comprises at least one vertically configured separating device between the at least two receptacles.

The at least two packaging blanks prepared by folding the edge regions are disposed in the receptacles of at least one application die, so that in each instance a folded-over edge region of a packaging in each instance rests against the separating device and wherein the separating device projects downward beyond the folded-over edge regions of the packaging.

The preparation of the packaging blanks can be carried out in particular in the manner described above, for example with a preparation die described above.

The application die with the prepared at least two packaging blanks is lowered over the articles supplied in the ordered mass flow, wherein the separating device plunges between articles of the ordered mass flow and after this the at least two packaging materials are applied in each instance to a defined number and composition of articles of the ordered mass flow in order to simultaneously form at least two adjacent packaging units.

According to a preferred embodiment, the separating device is formed by a vertical guide surface. One embodiment can provide that the lower side edge of the vertical guide surface has a profile, for example a wave shape. Alternatively, the separating device can be formed by at least one vertical guide finger, a guide cone or the like.

Due to the separating device a slight gap is created at least in an upper region between adjacent articles in the mass flow, in order to dispose the folded edge regions of the packaging between the respective articles of different article combinations and to be able to apply the packaging accordingly in each instance to the articles forming an article combination.

In addition, the application die can have lateral boundary surfaces, as described above, which serve as contact surfaces for outer lateral folded edge regions, in particular for edge regions that do not rest against the separating device. Analogous to the separating devices, the lateral boundary surfaces can also function as separating devices for further articles in the mass flow, which further articles are combined with packaging to form packaging units in a subsequent or preceding method step, in particular wherein a slight distance is created by the lateral boundary surfaces at least in an upper region between adjacent articles in the mass flow.

In the following, specific embodiments of the method and a correspondingly equipped packaging apparatus are described by way of example.

According to one embodiment, the application die can be formed from two second upper dies, which two second upper dies are disposed close enough after receiving the prepared packaging blanks that two of the adjacent boundary surfaces touch or almost touch. The adjacent boundary surfaces thus form a separating device between the two receptacles formed by the two second upper dies.

The folded edge regions of the two prepared packaging materials rest against the respective lateral boundary surfaces, wherein in each instance one edge region of each packaging material rests against the separating device formed by the two adjacent boundary surfaces of the two second upper dies.

The lateral boundary surfaces and the separating device protrude downward beyond the folded edge regions of the two prepared packaging materials.

An alternative embodiment can provide that two lower dies, with in each instance a prepared packaging blank, are disposed directly adjacent to one another after the packaging blanks have been prepared. The two prepared packaging blanks are grasped by an application die which comprises two correspondingly disposed receptacles for prepared packaging blanks, wherein a vertically configured separating device is provided between the two receptacles. After the prepared packaging blanks have been picked up, the folded edge regions of each packaging material rest against in each instance a separating device or a lateral contact surface in the manner described above.

The configuration of application dies with which more than two packaging materials can be applied to articles at the same time to simultaneously form more than two packaging units is, analogous to the examples described above, understandable to a person skilled in the art.

The special embodiment for the simultaneous application of at least two packaging materials to article combinations can be used for article combinations which are directly adjacent to one another in the mass flow, are moved parallel to one another, or for article combinations which are moved directly one after the other in the mass flow.

For example, the simultaneous application of four packaging materials can lead to the formation of four packaging units, wherein two leading packaging units are produced in parallel next to one another, which units are immediately followed by two further packaging units disposed in parallel next to one another.

With the special embodiment of the packaging apparatus and the corresponding method, packaging units can be produced in particular from an ordered mass flow of articles fed end to end, which packaging units are also configured end to end and are transported further in this form.

Furthermore, it can be provided that a packaging apparatus for applying packaging to an article combination or a packaging apparatus for simultaneously applying at least two packaging materials to articles for simultaneously forming at least two packaging units provides two or more corresponding application dies. These can work parallel to one another in the transport direction of the articles or can be disposed one after the other in the transport direction.

If the at least two application dies are disposed one after the other in the transport direction, it is provided in particular that the first application die only processes every other article combination or every other cycle of article combinations, while the subsequent application die processes in particular the intermittent article combinations or cycles of article combinations not processed by the first application die.

Due to the use of a plurality of application dies within a packaging apparatus, the output of the packaging apparatus can be increased. In particular, it is provided that each application die is assigned its own preparation dies.

It should be expressly mentioned at this point that all aspects and embodiment variants which have been explained in connection with the device according to the invention can also relate to, or be, partial aspects of the method according to the invention. Therefore, if the description or the claim definitions pertaining to the device according to the invention make mention of certain aspects and/or correlations and/or effects, this applies equally to the method according to the invention. The same applies vice versa so that all aspects and embodiment variants which have been explained in connection with the method according to the invention can also relate to, or be, partial aspects of the device according to the invention. Therefore, if the description or the claim definitions pertaining to the method according to the invention make mention of certain aspects and/or correlations and/or effects, this applies equally to the device according to the invention.

The following explanations again combine some aspects of the invention previously explained in different embodiment variants, clarify some aspects, but should not be considered in conflict with the statements already made, but in conjunction; in case of doubt, possibly as more specific variants and/or modifications.

As already mentioned several times above, a preparation die can be used to receive packaging. The packaging is normally formed by a flat packaging blank which has passage openings for at least the partial passage of the articles to be packaged therein. In addition, during the preparation of the packaging blank, the side edge regions of the packaging blank are usually folded downward and thus partially placed over the side surfaces of the article. In the finished packaging unit, these downwardly folded lateral edge regions at least partially surround or cover the outer lateral surfaces of the article combination combined with the packaging blank.

In particular, it can be provided that the packaging provides corresponding folding edges which can support or facilitate the folding process of the lateral edge regions.

Preferably, the preparation die comprises a first upper die and a lower die. The upper die preferably comprises at least one receiving device for the packaging blank, for example a retaining pin, which can engage in a suitable receiving opening of the packaging blank.

Alternatively, the upper die can also be equipped with a suction device, for example, in order to securely grasp and hold the packaging blank.

The lower die can also comprise an arrangement of expansion tools, which are also referred to below as expansion cones. The number and arrangement of the expansion cones corresponds logically to the number and arrangement of the passage openings in the packaging blank.

The upper die with the packaging blank disposed on it can be placed on the lower die so that the expansion cones at least partially pass through the passage openings of the packaging blank. Due to the downward widening cross-sectional area of the expansion cones, the edge regions of the passage openings can be pre-broken and formed based on the shape predefined by the expansion cones.

Preferably, the passage openings have suitable fixing devices, which can be formed, for example, by fixing tabs. For example, fixing tabs can be formed by notches or the like extending radially from the passage openings.

Due to the expansion cones, the fixing tabs are pre-broken at the notches and can be folded upward at least slightly.

Preferably, the packaging blank is pressed down by the upper die until it stops against the expansion cones of the lower die. The corner regions of the lower die also preferably form a free-form surface for forming the corners of the packaging blank to be formed between the foldable edge regions.

It is apparent to a person skilled in the art that the lower die can also be brought into operative connection with the upper die by an upward movement, either in addition to or as an alternative to the downward movement of the upper die.

The unit with which the upper die and the lower die are in operative connection can also be called a pre-breaking unit.

A further component of the preparation die can be configured as a folding device or folding element. The preparation die comprises at least the upper die, the lower die and the folding element. This folding element typically has lateral surfaces that are at least partially vertically aligned and also access openings for sub-regions of the first upper die and guide receptacles for guide elements of the first upper die.

The folding element moves downward onto the pre-breaking unit formed by the upper die and the lower die. In this case, the lateral edge regions of the packaging blank disposed between the upper die and the lower die that protrude from the pre-breaking unit are folded downward by the side surfaces of the folding element.

Furthermore, the sub-regions of the first upper die engage through the access openings of the folding element, and the guide elements of the first upper die engage in the guide receptacles of the folding element. This allows the folding element to be placed securely on the pre-breaking unit.

The connection between the receiving device of the upper die and the packaging blank prepared by pre-breaking and pre-folding can now be released. This allows the folding element to be moved upward together with the upper die. For example, it can be provided that the upper die is grasped at the sub-regions that protrude upward and lifted upward, wherein the folding element that is in operative connection with the upper die via the access openings is also necessarily moved upward.

The upper die, the lower die and the folding element thus form common components of one possible embodiment of a preparation die for preparing the packaging, which preparation die comprises at least one folding device in the form of the folding element, which is configured to fold at least two opposing edge regions—in particular all four edge regions of a rectangular packaging blank forming the packaging—approximately 90 degrees.

The appropriately prepared packaging blank remains resting at least partially on the lower die.

The prepared packaging blank can then be grasped by a second upper die of an application die equipped with boundary surfaces extending downward on the sides. Analogous to the first upper die, the second upper die is preferably also equipped with receiving devices for the packaging blank, in particular for receiving the correspondingly prepared packaging blank.

The second upper die is applied to the lower die, on which the prepared packaging blank at least partially rests, and the prepared packaging blank is grasped by the receiving devices, for example by hooks, suction cups or similar suitable receiving devices.

The lateral boundary surfaces of the second upper die protrude far enough downward that the downwardly folded lateral edge regions of the prepared packaging blank are completely covered by the lateral boundary surfaces. In particular, the lateral boundary surfaces ensure that the downwardly folded edge regions of the correspondingly prepared packaging blank remain in the folded state.

The packaging blank prepared in this way can then be applied to an article combination. Such an article combination is formed in particular by a plurality of articles. The articles or containers are preferably beverage containers, in particular bottles made of PET or of another suitable plastics material.

Preferably, the articles or containers can also be formed by cans made of plastics material and/or aluminum or another metal or the like. However, the application die described here is also suitable for disposing a suitably prepared packaging blank on other suitable articles or containers and for securing it to them.

The application die, in particular the second upper die, is applied to the article combination from above together with the grasped prepared packaging blank. The second upper die is placed above the article combination in such a way that the lid regions of the cans pass through the passage openings of the prepared packaging blank. In particular, the prepared packaging blank is fixed below the flanged edge of the cans by engaging the fixing tabs below the flanged edge In particular, after the packaging blank has been secured to the cans, the lid region of the cans is located above the packaging blank, while the cylindrical can body is located below the packaging blank.

The laterally folded edge regions of the packaging blank surround the outer surfaces of the cylindrical can body below the flanged edge.

Due to the arrangement and fastening of the packaging blank on the articles, a packaging unit is formed. With the packaging unit, the packaging blank is preferably in engagement with the articles in such a way that the packaging blank is secured to the articles in a substantially stationary manner and the articles can no longer make any significant relative movements or changes in position relative to one another and relative to the packaging blank.

As a result, the packaging blank can be removed from the articles of the packaging unit again only by applying increased force with a force component directed upward, wherein the packaging blank is generally at least partially destroyed. The packaging blank preferably consists of a cardboard material, a plastics material, a cardboard-plastics composite material or the like.

The second upper die thus forms a possible embodiment of an application die which is configured to receive the prepared packaging from the lower die and to apply it to the article combination by a downward movement, so that the packaging applied to the articles is disposed at least in part between the articles, whereby the packaging applied to the articles at least partially surrounds outer lateral surfaces of the article combination. This can mean in particular that the folded edge regions of the packaging at least partially surround lateral outer surfaces of the article combination.

The passage openings of the packaging blank applied to the articles are fixed in particular to the respective lid regions of the articles or to the articles. Preferably, the fixing devices engage below the lid region. The folded edge regions of the packaging form a collar around an upper region of the outer lateral surfaces of the articles.

According to an alternative embodiment, it can be provided that the folding element comprises, instead of the side surfaces, a type of cage or frame made of vertical metal sheets, which, in addition to folding, take over the function of the lateral boundary surfaces of the second upper die. In this case, it can be provided that the appropriately prepared packaging blank is removed directly from the lower die with the first upper die and the cage or frame and that the prepared packaging blank can now be disposed directly on the articles of the article combination.

Using an application die, a plurality of prepared packaging blanks can be applied to items at the same time. For example, four prepared packaging blanks can be applied to articles at the same time, in particular to articles that are fed in an ordered mass flow.

The articles can be moved in a defined transport direction, in particular in an ordered mass flow. For example, the articles are pushed over a transfer plate using a push rod. The mass flow is preferably limited on the outside by guide elements, such as lane separators or lateral guide rails or the like.

Furthermore, within the mass flow, a further guide can be provided by a central guide element in the form of a central lane separator or a central separating strip. In this case, a plurality of articles are in each instance combined into one packaging unit on one side of the central guide element by packaging.

The preparation of the packaging blanks is carried out in particular as explained above. The application die can, for example, be formed from four second upper dies which, after receiving the prepared packaging blanks, are disposed close enough together that in each instance adjacent boundary surfaces touch or almost touch one another and form a separating element or a separating device. The upper dies form receptacles for the prepared packaging, wherein the folded edge regions of each packaging material rest against in each instance a separating device, and wherein the separating device projects downward beyond the folded edge regions of the prepared packaging.

Alternatively, four lower dies with prepared packaging blanks can be disposed directly adjacent to one another. In this case, the four prepared packaging blanks are grasped by an application die which comprises four correspondingly disposed receptacles for prepared packaging blanks and in each instance a vertically configured separating device between two adjacent receptacles, wherein the folded edge regions of each packaging material each rest in each instance against a separating device, and wherein the separating device projects downward beyond the folded edge regions of the prepared packaging.

The application dies are configured to dispose the separating devices between the articles fed in the ordered mass flow and to form at least a small distance between the articles which are to be assigned to different article combinations, because these subsequently form different packaging units.

In particular, due to the application die, in each instance four prepared packaging blanks are disposed on articles.

The articles to be grouped together in each instance by a packaging blank form a respective article combination within the mass flow, even if these article combinations are not visibly separated from adjacent articles within the mass flow.

The application die is in particular configured to apply the four prepared packaging blanks to form four packaging units simultaneously, in each instance on a defined number and combination of articles of the ordered mass flow.

A further embodiment of a packaging apparatus can be configured in particular to apply at least two packaging materials to articles, in order to simultaneously form two, in particular adjacent, packaging units.

This embodiment of the packaging apparatus can comprise a feeding transport device, via which articles are preferably fed in an ordered mass flow in a defined transport direction. This can be, for example, a transfer plate with a push rod or a conveyor belt or other suitable transport device.

In particular, identically configured articles are processed in each instance. The packaging materials, which is configured in particular as packaging blanks, as already described above, are prepared in a preparation module with a corresponding preparation die by folding over at least the lateral edge regions of the packaging blanks. If necessary, additional preparation, in particular pre-breaking, of the passage openings can be provided.

The packaging blanks are provided, for example, in a magazine assigned to the preparation module. Subsequently, for example, two prepared packaging blanks are taken over by an appropriately configured application die and applied to the articles of the mass flow in an application module to form two adjacent, in particular adjacent, packaging units.

In this case, adjacent articles, which subsequently form different packaging units, are slightly pushed apart by the separating device of the application die, at least in an upper region, in order to dispose the lateral edge regions of the packaging blanks between the articles.

Optionally, the preparation module and, if applicable, the magazine can be integrated into the application module.

For example, the application die can comprise four receptacles for in each instance four prepared packaging blanks and separating devices disposed accordingly between the four receptacles, so that four packaging units can be produced simultaneously within the mass flow in one work cycle.

Alternatively, the application die can comprise two receptacles for in each instance two prepared packaging blanks and a separating device disposed between the two receptacles, so that two packaging units disposed next to one another can be produced simultaneously within the mass flow in one work cycle.

According to a further embodiment, it can be provided that the packaging apparatus in the application module uses two application dies in parallel, each with two receptacles for in each instance two prepared packaging blanks, wherein the first of the two application dies can produce two packaging units disposed one behind the other in a defined transport direction in one work cycle and at the same time the second of the two application dies can produce two packaging units disposed one behind the other in the transport direction within the mass flow in one work cycle.

With a further embodiment of a packaging apparatus, two application modules can optionally be disposed one behind the other in the transport direction. Each of the application modules can also be assigned a preparation module and a magazine. Alternatively, it can be provided that the two preparation modules access a common magazine.

The application modules can be disposed directly one after the other, if necessary at reasonable distances from one another. The first application module only processes in each instance every other cycle and produces four packaging units, wherein disposed between in each instance two cycles of four packaging units in each instance is a corresponding article combination, from which four packaging units are subsequently produced in the second application module. Due to the arrangement of two application modules one behind the other, the throughput of the packaging apparatus can be increased.

A further embodiment of a packaging apparatus can in particular be configured to apply four packaging materials to a total of sixteen articles, in order to simultaneously form four adjacent packaging units.

Such a packaging apparatus can, for example, comprise a grouping module or dividing module in which article groups comprising sixteen articles in each instance are formed. The article groups are fed to the application module in the transport direction via the feeding transport device. The transport device can, for example, be a transfer plate with a push rod or a conveyor belt or another suitable transport device.

In this case as well, the articles are preferably identically configured and processed together and combined into packaging units using packaging.

For example, the packaging is prepared as described above. In particular, the application die can comprise four receptacles for four prepared packaging blanks in each instance and separating devices disposed accordingly between the four receptacles, so that in one work cycle four packaging units are produced simultaneously from each of the article groups fed to the application module. Each of the four packaging units contains four articles.

BRIEF DESCRIPTION OF THE FIGURES

Exemplary embodiments of the invention and their advantages are explained in more detail below with reference to the accompanying figures. The proportions of the individual elements relative to one another in the figures do not always correspond to the actual proportions, since some forms are simplified, while other forms are shown enlarged in relation to other elements for better illustration.

DETAILED DESCRIPTION OF THE INVENTION

Figure 1:
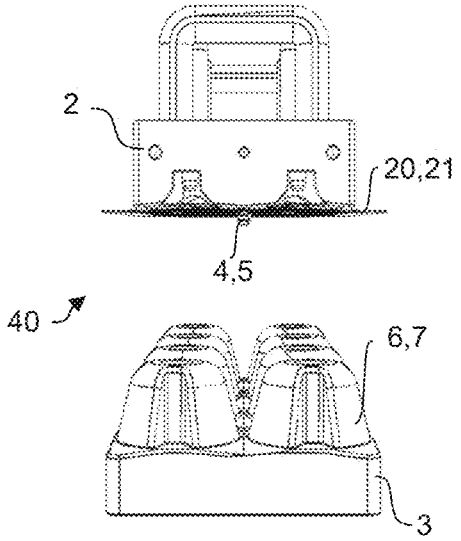
FIGS. 1 and 2 show the receptacle of packaging by a preparation die in different perspective views.

Identical reference numerals are used for identical elements of the invention or those having the same effect. Furthermore, for the sake of clarity, only reference signs are shown in the individual figures, which are required for the description of the respective figure. The illustrated embodiments are merely examples of how the device according to the invention or the method according to the invention can be configured, and they are non-limiting.

Figure 2:
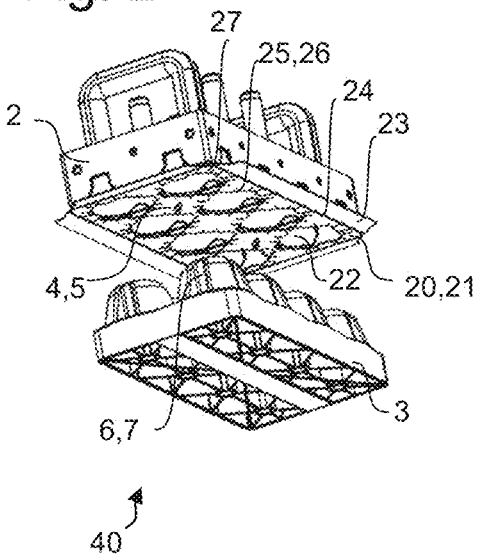

The schematic views of FIGS. 1 and 2 show the receiving of packaging 20 by a preparation die 40.

The packaging 20 is formed by a flat packaging blank 21 which has passage openings 22 for the at least partial passage of the articles to be combined. As part of the preparation of the packaging blank 21, lateral edge regions 23 of the packaging blank 21 are folded downward. In the finished packaging unit, these downwardly folded lateral edge regions 23 at least partially surround outer lateral surfaces of the article combination.

In particular, it can be provided that the packaging 20 provides corresponding folding edges 24 which support or facilitate the process of folding the lateral edge regions 23.

The preparation die 40 comprises a first upper die 2 and a lower die 3. The upper die 2 comprises at least one receiving device 4 for the packaging blank 21, for example a retaining pin 5, which engages in a suitable receiving opening of the packaging blank. Alternatively, the upper die 2 can also be equipped with a suction device, for example, in order to securely grasp and hold the packaging blank 21.

The lower die 3 comprises an arrangement of expansion tools 6, which are also referred to below as expansion cones 7. The number and arrangement of the expansion cones 7 corresponds to the number and arrangement of the passage openings 22 of the packaging blank 21.

Figure 3:
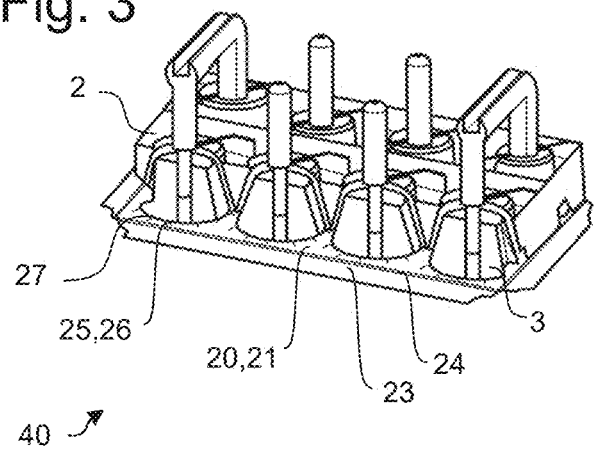
FIGS. 3 and 4 show a first step in the preparation of packaging using a preparation die.
Figure 4:
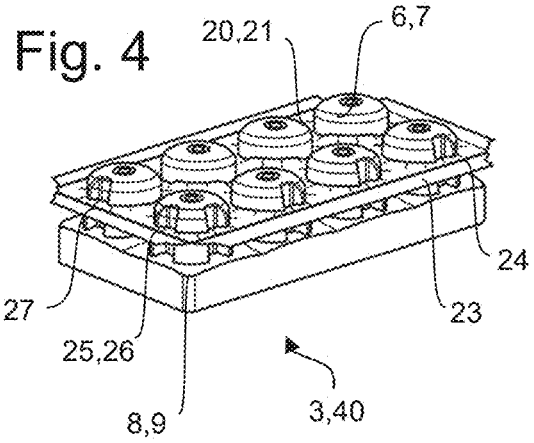

The schematic perspective representations of FIGS. 3 and 4 show a first step in the preparation of packaging 20; in particular FIG. 4 shows only the lower die 3 with the packaging blank 21.

The upper die 2 with the packaging blank 21 disposed thereon is now placed on the lower die 3, so that the expansion cones 6 at least partially pass through the passage openings 22 of the packaging blank 21. Due to the downwardly widening cross-sectional area of the expansion cones 7, the edge regions of the passage openings 22 are pre-broken and formed based on the shape predefined by the expansion cones 6.

Preferably, the passage openings 22 have suitable fixing devices 25, which can be formed, for example, by fixing tabs 26. For example, fixing tabs are formed by notches 27 or the like extending radially from the openings.

Due to the expansion cones 7, the fixing tabs 26 are pre-broken at the notches 27 and can thereby be folded upward at least slightly.

Preferably, the packaging blank 21 is pressed down by the upper die 2 until it stops on the expansion cones 7 of the lower die 3.

The corner regions 8 of the lower die 3 also form a free-form surface 9 for forming the corners of the packaging blank 21 to be formed between the foldable edge regions 23.

For a person skilled in the art, it is of course self-evident that the lower die 3 can also be brought into operative connection with the upper die 2 by an upward movement.

The unit with which the upper die 2 and the lower die 3 are operatively connected is also referred to as the pre-breaking unit 20.

Figure 5:
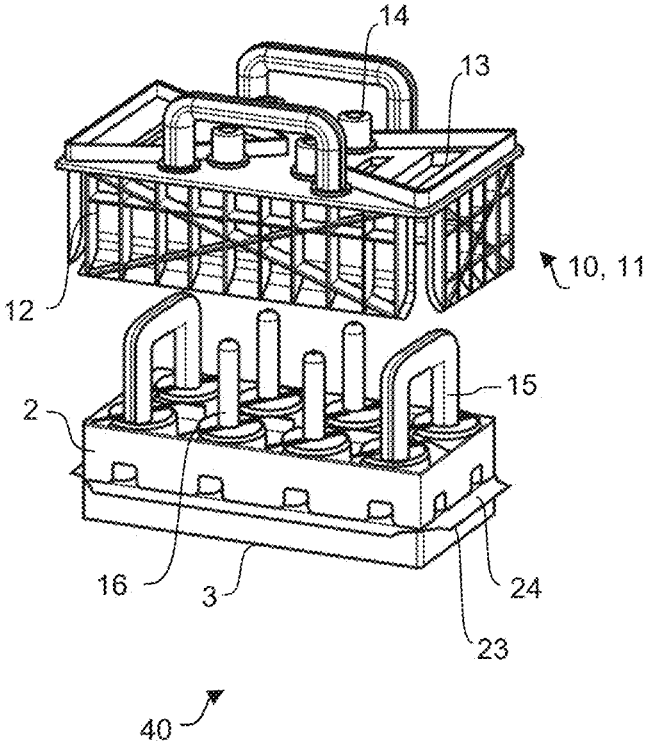
FIGS. 5 to 7 show the folding of the side edge regions of the packaging blank.
Figure 6:
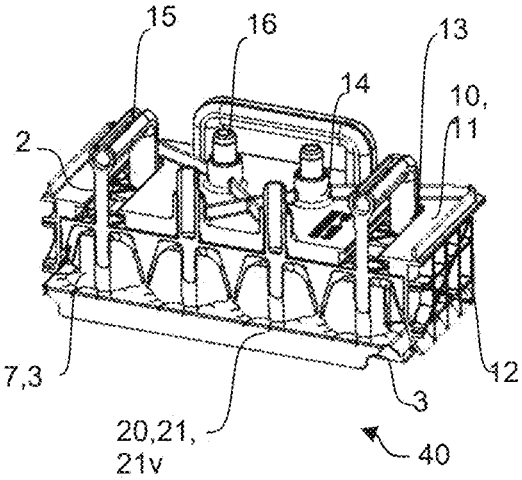
Figure 7:
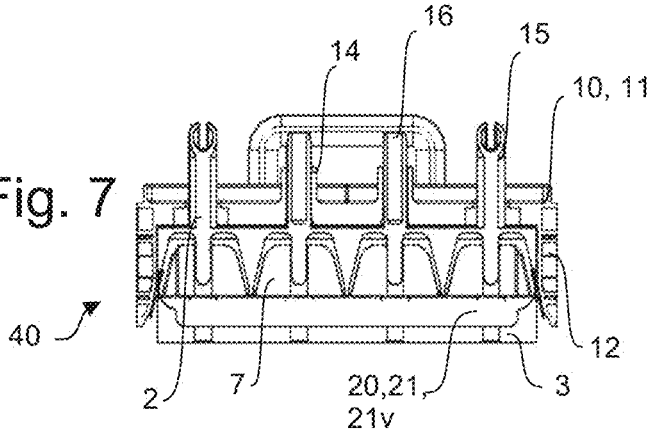

FIGS. 5 to 7 show the folding of the lateral edge regions 23 of the packaging blank 21. In particular, FIG. 5 additionally shows a further component 11 of the preparation die 40 configured as a folding device or folding element 10. In particular, FIGS. 6 and 7 show different perspective views of sectional views of a preparation die 40 formed from upper die 2, lower die 3 and folding element 10.

The folding element 10 has lateral, at least partially vertically aligned, side surfaces 12 and also access openings 13 for sub-regions 15 of the first upper die 2 and guide receptacles 14 for guide elements 16 of the first upper die 2.

The folding element 10 moves downward onto the pre-breaking unit 20 formed by the upper die 2 and the lower die 3. In this case, the lateral edge regions 23 of the packaging blank 21 disposed between the upper die 2 and the lower die 3, which edge regions protrude laterally from the pre-breaking unit 20, are folded downward by the side surfaces 12 of the folding element 10.

Furthermore, the sub-regions 15 of the first upper die 2 reach through the access openings 13 of the folding element 10 and the guide elements 16 of the first upper die 2 reach into the guide receptacles 14 of the folding element 10. This allows a secure and guided placement of the folding element 10 onto the pre-breaking unit 20.

Now the connection between the receiving device 4 of the upper die 2 and the packaging blank 21 prepared by pre-breaking and pre-folding is released, and the folding element 11 moves upward together with the upper die 3. For example, it can be provided that the upper die 3 is grasped at the upwardly projecting sub-regions 15 and lifted upward, wherein the folding element 11, which is in operative connection with the upper die 3 via the access openings 13, is also necessarily moved upward.

The upper die 2, the lower die 3 and the folding element 10 thus form components of a possible embodiment of a preparation die 40 for preparing the packaging 20, which preparation die 40 comprises at least one folding device in the form of the folding element 10, which is configured to fold at least two opposing edge regions 23—in particular all four edge regions of a rectangular packaging blank 21 forming the packaging 20—by 90 degrees.

Figure 8:
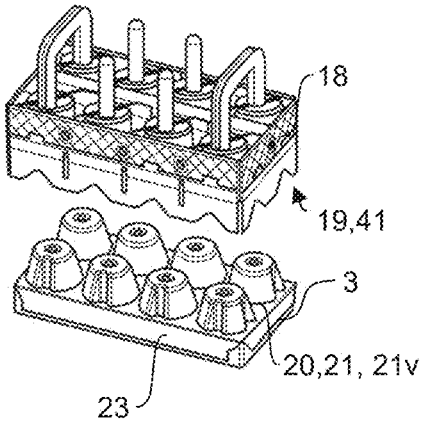
FIGS. 8 to 10 show the grasping of the prepared packaging blank.

The correspondingly prepared packaging blank 21, which is subsequently identified by the reference sign **21*v*, remains resting at least partially on the lower die 3, as can be seen in FIG. 8**.

Figure 9:
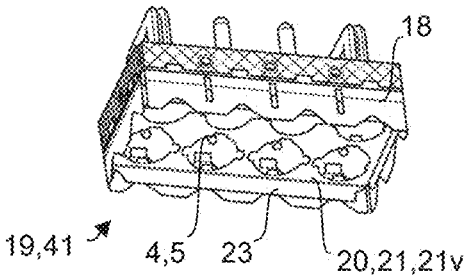
Figure 10:
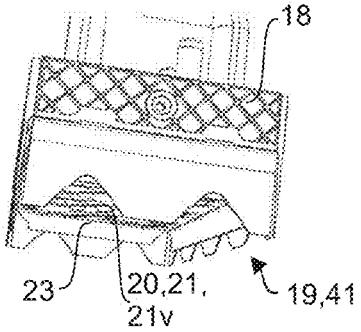

FIGS. 8 to 10 show the grasping of the prepared packaging blank **21*v* by a second upper die 19 of an application die 41, which is equipped with boundary surfaces 18 extending downward at the sides. Analogous to the first upper die 3 (see FIGS. 1 to 3), the second upper die 19 is also equipped with receiving devices 4 for the packaging blank 21, in particular for receiving the correspondingly prepared packaging blank 21*v***.

The second upper die 19 is applied to the lower die 3 on which the prepared packaging blank **21*v* at least partially rests, and the prepared packaging blank 21*v* is grasped by the receiving devices 4, for example by hooks, suction cups or similar suitable receiving devices 4. The lateral boundary surfaces 18 of the second upper die 19 protrude downward to such an extent that the downwardly folded lateral edge regions 23 of the prepared packaging blank 21*v* are completely covered by the lateral boundary surfaces 18. In particular, the lateral boundary surfaces 18 ensure that the downwardly folded edge regions 23 of the correspondingly prepared packaging blank 21*v*** remain in the folded state.

Figure 11:
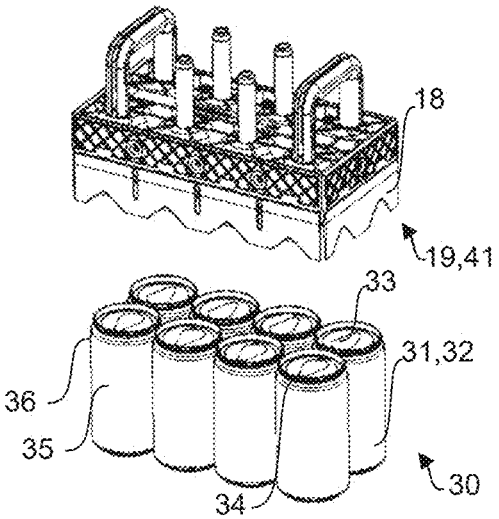
FIGS. 11 and 12 show the application of the prepared packaging blank to an article combination.
Figure 12:
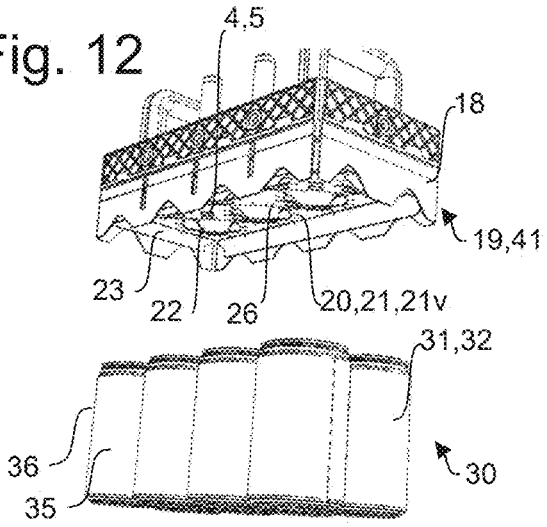

FIGS. 11 and 12 show the application of the prepared packaging blank **21*v* to an article combination 30**.

The article combination 30 is formed in particular by a plurality of articles 31. Articles 31 or containers are preferably beverage containers, in particular bottles made of PET or another suitable plastics material. Preferably, the articles 30 or containers can also be formed by cans 32 made of plastics material and/or aluminum or another metal or the like. However, the application die 41 shown is also suitable for disposing a suitably prepared packaging blank **21*v* on other suitable articles 31** or containers and for securing it to them.

The application die 31, in particular the second upper die 19, is applied together with the grasped prepared packaging blank **21*v* from above onto the article combination 31. The second upper die 19 is placed above the article combination 31 in such a way that the lid regions 33 of the cans 32 pass through the passage openings 22 of the prepared packaging blank 21***v*. In particular, the prepared packaging blank 21*v* is fixed below the flanged edge 34 of the cans 32 by engaging the fixing tabs 26 below the flanged edge 34.

In particular, the lid region 33 of the cans 32 is thus located above the packaging blank 21 after the packaging blank 21 has been fixed to the cans 32, while the cylindrical can body 35 is located below the packaging blank 21.

The laterally folded edge regions 23 of the packaging blank 21 surround outer lateral surfaces 36 of the cylindrical can body 35 below the flanged edge 34.

Due to the arrangement and fastening of the packaging blank 21 on the articles 31, a packaging unit is formed (not shown). With the packaging unit, the packaging blank 21 is in engagement with the articles 31 in such a way that the packaging blank 21 is secured to the articles 31 in a substantially stationary manner, and the articles 31 can no longer make any significant relative movements or changes in position relative to one another and relative to the packaging blank 21. As a result, the packaging blank 21 can be removed from the articles 31 of the packaging unit again only by applying increased force with an upwardly directed force component, wherein the packaging blank 21 is generally at least partially destroyed. The packaging blank 21 preferably consists of a cardboard material, a plastics material, a cardboard-plastics composite material or the like.

The second upper die 19 thus forms a possible embodiment of an application die 41 which is configured to receive the prepared packaging 21*v* from the lower die 3 and to apply it to the article combination 30 by a downward movement, so that the packaging 21*v* applied to the articles 31 is disposed at least in part between the articles 31 and so that the packaging 21*v* applied to the articles 31 at least partially surrounds outer lateral surfaces 36 of the article combination 30, in particular wherein the folded-over edge regions 23 of the packaging 21*v* at least partially surround outer lateral surfaces 36 of the article combination 31. The passage openings 22 of the packaging blank 21 applied to the articles 31 are fixed in particular to a lid region 33 of the articles 31. Preferably, the fixing devices 25 engage below the cover region 33. The folded edge regions 23 of the packaging 21 form a collar around an upper region of the outer surfaces 36 of the articles 31.

According to an alternative embodiment, it can be provided that the folding element 10, instead of the side surfaces 12 according to FIGS. 5 to 7, comprises a type of cage or frame made of vertical metal sheets, which, in addition to folding, take over the function of the lateral boundary surfaces 18 of the second upper die 19. In this case, it is provided that the correspondingly prepared packaging blank 21*v* is removed directly with the first upper die 2 and the cage or frame from the lower die 3 and that the prepared packaging blank 21*v* can now be disposed directly on the articles 31 of the article combination 30.

Figure 13:
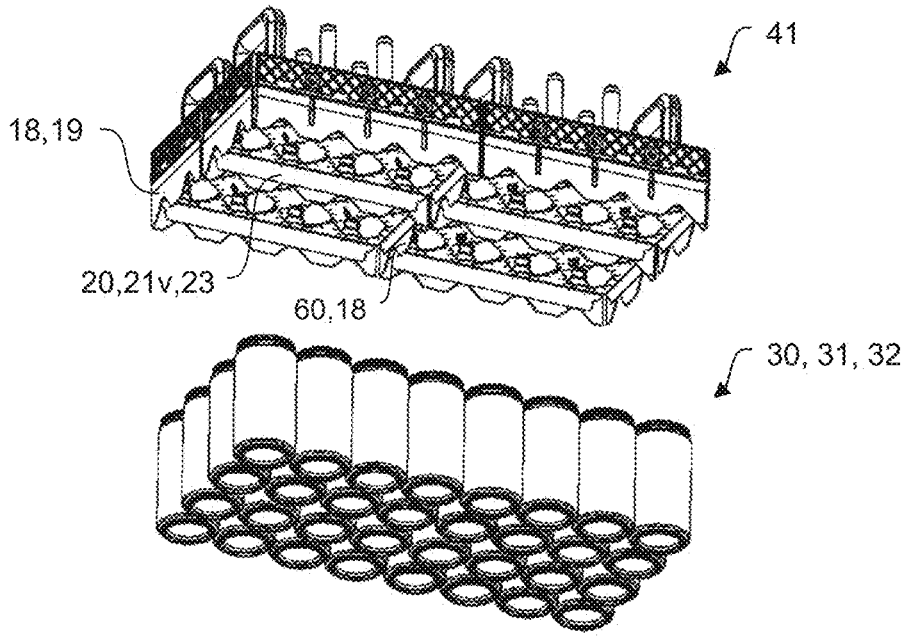
FIG. 13 shows an application die for simultaneously applying four prepared packaging blanks to articles.
Figure 14:
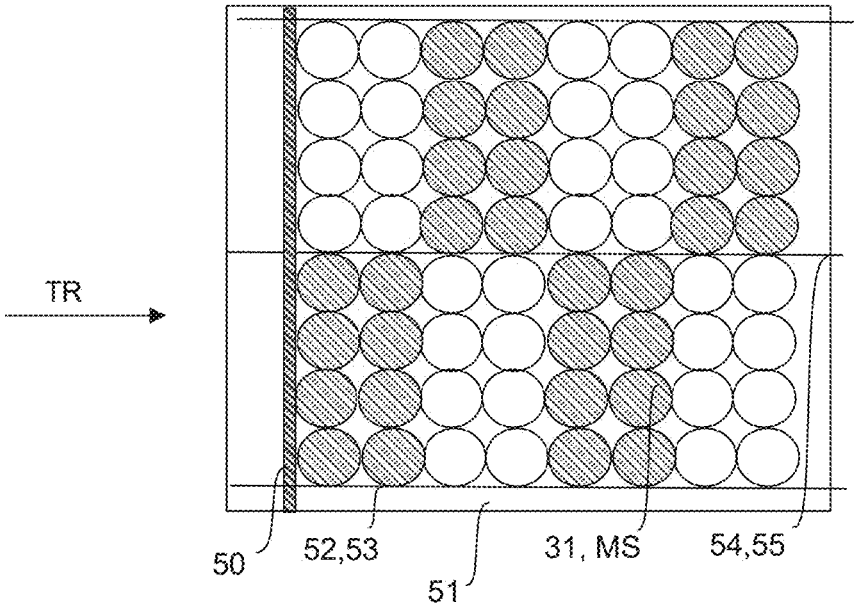
FIG. 14 shows the feeding of articles in the ordered mass flow.

The perspective view of FIG. 13 shows an application die 41 for simultaneously applying four prepared packaging blanks 21*v* to articles 31, in particular to articles 31 which are fed in the ordered mass flow MS, as shown in FIG. 14.

Figure 15:
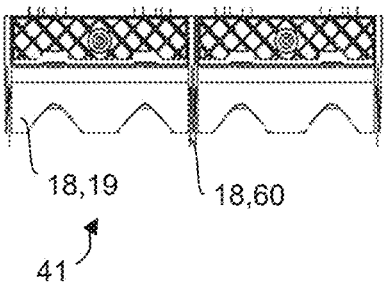
FIGS. 15 to 18 show further views of the application die according to FIG. 13.
Figure 16:
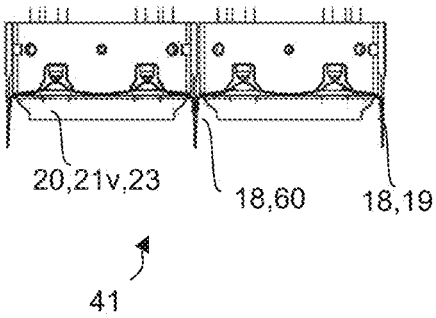
Figure 17:
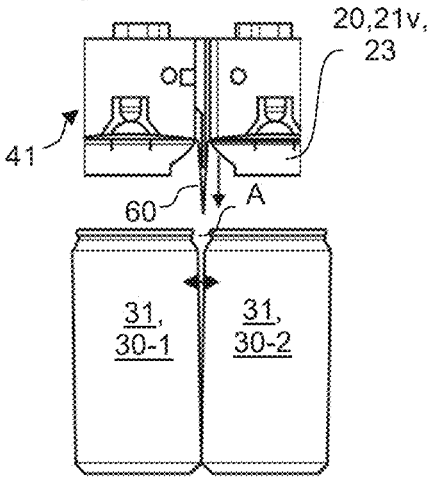
Figure 18:
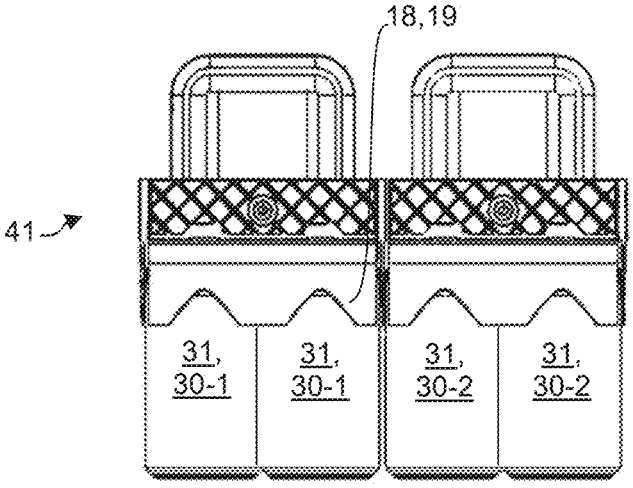

FIGS. 15 to 18 show further views of the application die 41 according to FIG. 13, wherein in particular FIG. 15 shows a side view, while FIG. 16 shows a sectional view. In addition, FIGS. 17 and 18 show by way of example the arrangement of the application die 41 on the articles 31.

Articles 31 are moved in particular in the ordered mass flow MS in the transport direction TR. For example, the articles 31 are pushed over a transfer plate 51 by a push rod 50. The mass flow MS is preferably limited on the outside by guide elements 52, for example lane separators 53. Furthermore, within the mass flow MS a further guiding can be provided by a central guide element 54 in the form of a central lane separator 55. In this case, a plurality of articles 31 are in each instance combined on one side of the central guide element 52 by packaging 20 to form a packaging unit.

The preparation of the packaging blanks 21 takes place, for example, as described in connection with FIGS. 1 to 7. The application die 41 is formed from four second upper dies 19, which, after receiving the prepared packaging blanks 21*v*, are disposed close enough together that in each instance adjacent boundary surfaces 18 touch or almost touch one another and form a separating element or a separating device 60. The upper dies 19 form receptacles for the prepared packaging 21*v*, wherein the folded edge regions 23 of each packaging 21*v* in each instance rests against a separating device 60 and wherein the separating device 60 projects downward beyond the folded edge regions 23 of the prepared packaging 21*v*.

Alternatively, four lower dies with prepared packaging blanks 21*v* (see FIG. 3) are disposed directly adjacent to one another and the four prepared packaging blanks 21*v* are grasped by an application die 41, which comprises four correspondingly disposed receptacles for prepared packaging blanks 21*v* and in each instance a vertically configured separating device 60 between two adjacent receptacles, wherein the folded edge regions 23 of each packaging 21*v* in each instance rests against a separating device 60, and wherein the separating device 60 projects downward beyond the folded edge regions 23 of the prepared packaging 21*v*.

The application dies 41 are configured to dispose the separating devices 60 between the articles 31 supplied in the ordered mass flow MS and to form at least a small distance A between the articles 31, which articles 31 are to be assigned to different article combinations 30-1, 30-2, because these subsequently form different packaging units.

In particular, four prepared packaging blanks 21*v* are in each instance disposed on articles 31 by the application die 41.

The articles 31 to be combined in each instance by a packaging blank 21*v* form a respective article combination 30 within the mass flow MS, even if this article combination 30 is not visibly separated from adjacent articles 31 within the mass flow MS. The hatching used in the figures is for the purpose of improving understanding only.

The application die 41 is configured in particular to apply the four prepared packaging blanks 21*v* to form four packaging units simultaneously in each instance to a defined number and composition of articles 31 of the ordered mass flow MS.

Figure 19:
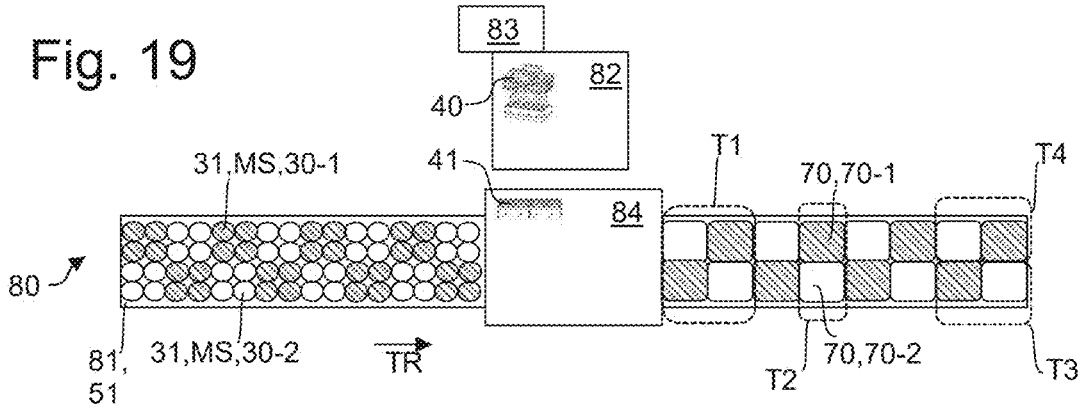
FIG. 19 shows an embodiment of a packaging apparatus.

FIG. 19 shows an embodiment of a packaging apparatus 80, which is configured in particular to apply at least two packaging materials 21 to articles 31, in order to simultaneously form two, in particular adjacent, packaging units 70, 70-1, 70-2.

The packaging apparatus 80 comprises a feeding transport device 81, via which articles 31 are preferably fed in the ordered mass flow MS in the transport direction TR. This can be, for example, a transfer plate 51 with a push rod according to FIG. 14 or a conveyor belt or another suitable transport device 81.

In particular, these are identically configured Article 31. The different hatchings were used in order to in each instance identify articles 31 which form an article combination 30, 30-1, 30-2, which are subsequently combined by packaging to form packaging units 70, 70-1, 70-2.

The packaging, which is configured in particular as packaging blanks, as described in connection with FIGS. 1 to 18, are prepared in a preparation module 82 with a corresponding preparation die 40 by folding over at least the lateral edge regions of the packaging blanks. If necessary, additional preparation, in particular pre-breaking, of the passage openings can be provided.

The packaging blanks are provided, for example, in a magazine 83 assigned to the preparation module 82. Subsequently, for example, two prepared packaging blanks are taken over by a suitably configured application die 41 and applied in an application module 84 to the articles 31 of the mass flow MS to form two adjacent, in particular bordering, packaging units 70-1, 70-2.

In this case, adjacent articles 31, which subsequently form different packaging units 70-1, 70-2, are slightly pushed apart by the separating device of the application die 41, at least in an upper region, in order to dispose the lateral edge regions of the packaging blanks between the articles 31.

An embodiment not shown can provide that the preparation module 82 and optionally the magazine 83 are integrated into the application module 84.

For example, the application die 41 can comprise four receptacles for four prepared packaging blanks in each instance and separating devices disposed accordingly between the four receptacles, so that four packaging units 70 can be produced simultaneously within the mass flow MS in one work cycle T1.

Alternatively, the application die 41 can comprise two receptacles for two prepared packaging blanks in each instance and a separating device disposed between the two receptacles, so that in one work cycle T2 two packaging units 70 disposed next to one another can be produced simultaneously within the mass flow MS.

According to a further embodiment, it can be provided that the packaging apparatus 80 in the application module 84 uses two application dies 41 in parallel, in each instance with two receptacles for two prepared packaging blanks in each instance, wherein two packaging units 70 disposed one behind the other in the transport direction TR can be produced by the first of the two application dies 41 in a work cycle T3 and two packaging units 70 disposed one behind the other in the transport direction TR can be produced within the mass flow MS at the same time by the second of the two application dies 41 in a work cycle T4.

Figure 20:
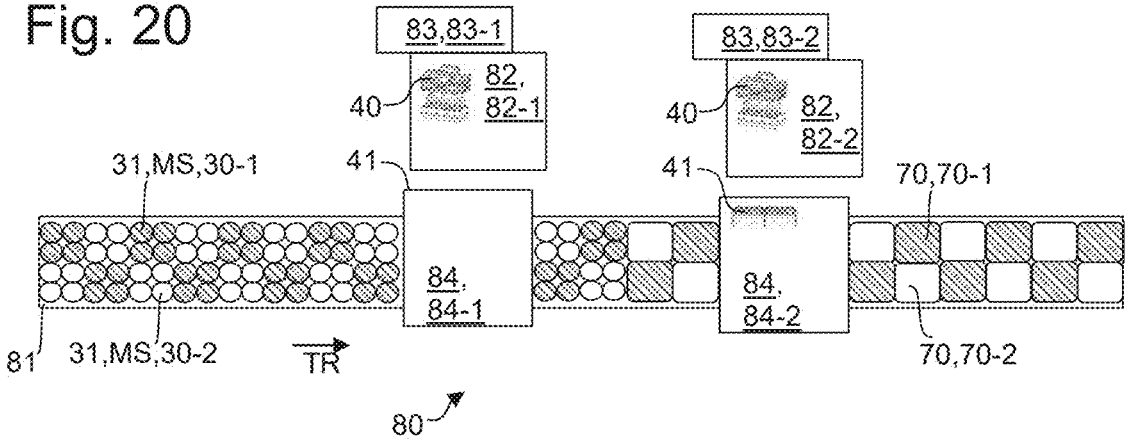
FIG. 20 shows a further embodiment of a packaging apparatus.

FIG. 20 shows a further embodiment of a packaging apparatus 80. Here, two application modules 84, 84-1, 84-2 are disposed one behind the other in the transport direction TR. Each of the application modules 84-1, 84-2 is assigned a preparation module 82-1, 82-2 and a magazine 83-1, 83-2. Alternatively, it can be provided that the two preparation modules 82-1, 82-2 access a common magazine.

The application modules 84-1, 84-2 can be disposed directly one after the other; to clarify the mode of operation, they are shown spaced apart. The first application module 84-1 only processes in each instance every other cycle and thereby produces four packaging units 70, wherein disposed between in each instance two cycles of four packaging units 70 in each instance is a corresponding article combination, from which four packaging units 70 are subsequently produced in the second application module 84-2. Due to the arrangement of two application modules 84 one behind the other, the throughput of the packaging apparatus 80 can be increased.

Figure 21:
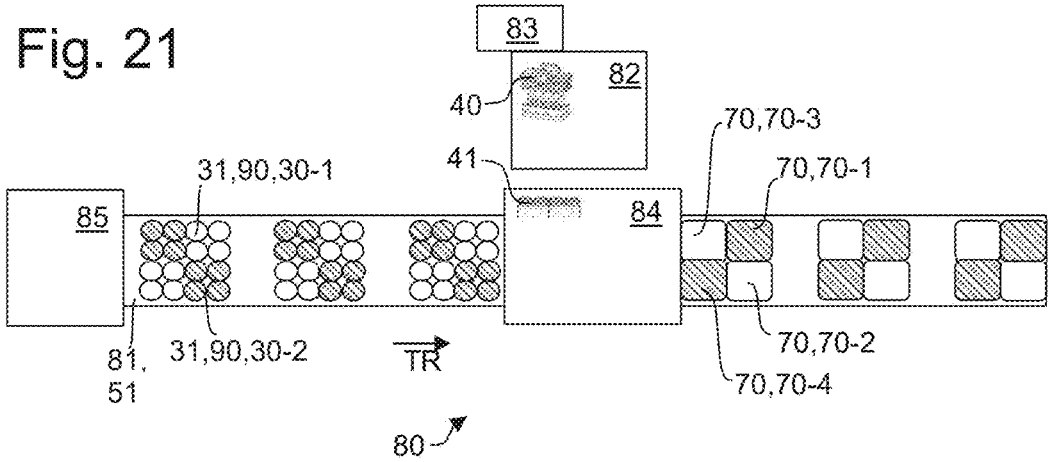
FIG. 21 shows a further embodiment of a packaging apparatus.

FIG. 21 shows a further embodiment of a packaging apparatus 80, which is in particular configured to apply four packaging materials 21 to sixteen articles 31, in order to simultaneously form four adjacent packaging units 70, 70-1, 70-2.

The packaging apparatus 80 comprises a grouping module or dividing module 85, in which article groups 90 in each instance comprising sixteen articles 31 are formed. The article groups 90 are fed to the application module 84 via the feeding transport device 81 in the transport direction TR. The transport device 84 can be, for example, a transfer plate 51 with a push rod according to FIG. 14 or a conveyor belt or another suitable transport device 81.

In this case as well, it is preferable to use identically configured Article 31. The different hatchings were used to identify articles 31 forming in each instance an article combination 30, 30-1, 30-2, which articles are subsequently combined by packaging to form packaging units 70, 70-1 to 70-2.

The packaging is prepared, for example, analogously to the embodiment of FIG. 19, to the description of which reference is hereby made. In particular, the application die 41 can comprise four receptacles in each instance for four prepared packaging blanks each and separating devices disposed accordingly between the four receptacles, so that in one work cycle four packaging units 70, in particular packaging units 70-1 to 70-4, are produced simultaneously from each of the article groups 90 fed to the application module 84. Each of the four packaging units 70 comprises four items 31.

The embodiments, examples and variants of the preceding paragraphs, the claims or the following description and the figures, including their various views or respective individual features, may be used independently of one another or in any combination. Features described in connection with an embodiment are applicable for all embodiments provided the features are not incompatible.

Even if in the context of the above description of the figures reference is also generally made to "schematic" representations and views, this in no way means that the figure representations and their description are to be of subordinate importance with regard to the disclosure of the invention. The person skilled in the art is certainly able to derive sufficient information from the schematically and abstractly drawn representations that will make it easier for the person skilled in the art to understand the invention without being confused in any way by the drawn and possibly not exactly true-to-scale proportions of the articles and/or parts of the device or other drawn elements. The figures enable the person skilled in the art as reader to get a better understanding of the inventive idea, which has been formulated more generally and/or more abstractly in the claims and in the general part of the description, on the basis of the more specifically explained implementations of the method according to the invention and the more specifically explained mode of operation of the device according to the invention.

The invention has been described with reference to a preferred embodiment. However, it is conceivable for a person skilled in the art that modifications or changes can be made to the invention without departing from the scope of protection of the following claims.

LIST OF REFERENCE SIGNS

1 first upper die
2 lower die
3 receiving device
5 retaining pin
6 expansion tool
7 expansion cone
8 corner region

9 freeform surface
10 folding element
11 component
12 side surface
13 access opening
14 guide receptacle
15 sub-region
16 guide element
18 lateral boundary surfaces
19 second upper die
20 packaging materials
21 packaging blank
**21*v*** prepared packaging blank
22 passage opening
23 lateral edge region
24 folding edge
25 fixing device
26 fixing tab
27 notch
30.30-1.30-2 article combination
31 article
32 can
33 lid region
34 flanged edge
35 can bodies
36 outer surface
40 preparation die
41 application die
50 push rod
51 transfer plate
52 external guide element
53 lane separator
54 central guide element
55 lane separator
60 separating device
70,70-1,70-2 packaging unit
80 packaging apparatus
81 supplying transport device
82,82-1,82-2 preparation module
83,83-1,83-2 magazine
84,84-1,84-2 application module
85 grouping module/dividing module
90 article group
A distance
MS ordered mass flow
TR transport direction

The invention claimed is:

1. A packaging apparatus (80) for applying packaging (20) to an article combination (30) having at least two articles (31), comprising:

at least one preparation die (40) comprising at least one folding device (10) configured to fold at least two opposing edge regions (23) of a packaging blank (21) to approximately 90 degrees, and at least one application die (41) configured to receive the folded packaging blank (21) and to apply it to the article combination (30) by a downward movement, so that the folded packaging blank (21) applied to the articles (31) is disposed, at least, in part, between the articles (31) and at least partially surrounds outer lateral surfaces (36) of the article combination (30).

2. The packaging apparatus (80) of claim 1, wherein the application die (41) comprises: at least two receptacles disposed next to one another, and at least one vertically formed or vertically aligned separating device (60) between the at least two receptacles, wherein a folded edge region (23) of each packaging blank (21) rests against the separating device (60), and wherein the separating device (60) projects downward beyond the folded edge regions (23) of the packaging blanks (21), wherein the application die (41) is configured to dispose the separating device (60) between the articles (31) supplied in an ordered mass flow (MS) and to apply the at least two packaging blanks (21) to form at least two adjacent packaging units (70) simultaneously or approximately simultaneously for a defined number and composition of articles (31) of the ordered mass flow (MS).

3. The packaging apparatus (80) of claim 2, wherein the preparation die (40) further comprises devices for preparing passage openings (22) of the packaging blank (21).

4. The packaging apparatus (80) of claim 3, wherein the preparation die (40) comprises:

an upper die (2) having at least one receiving device (4) or holding device for the packaging blank (21), and a lower die (3) having a plurality of expansion tools (6).

5. The packaging apparatus (80) of claim 4, wherein the preparation die (40) comprises an exchangeable format part that is configurable to correspond to a number and arrangement of the passage openings (22) of the packaging blank (21) to be processed.

6. The packaging apparatus (80) of claim 5, wherein the application die (41) has lateral boundary surfaces (18), against which lateral boundary surfaces (18), the folded edge regions (23) of the packaging blank (21) are held in their folded arrangement or folded position during application to the articles (31).

7. The packaging apparatus (80) of claim 6, wherein the separating device (60) comprises a vertical guide surface or at least one vertical guide finger or guide cone.

8. The packaging apparatus (80) of claim 1 wherein the folded edge regions (23) of the packaging blank (21) at least partially surround outer lateral surfaces (36) of the article combination (30).

9. A method for applying packaging (20) to an article combination (30) comprising at least two articles (31), the method comprising:

folding over to approximately 90 degrees at least two opposing edge regions (23) of at least two packaging blanks (21), feeding the articles (31) directly adjacent to one another in an ordered mass flow (MS), disposing the at least two folded packaging blanks (21) next to one another in receptacles of at least one application die (41), wherein the application die (41) comprises at least one vertically formed or vertically aligned separating device (60) between the receptacles, wherein the folded edge region (23) of the packaging blanks (21) rests against the separating device (60), and wherein the separating device (60) projects downward beyond the folded edge regions (23) of the packaging blanks (21), lowering the application die (41), with the at least two folded packaging blanks (21), over the articles (31) being fed in the ordered mass flow (MS), inserting the separating device (60) between articles (31) of the ordered mass flow (MS) and whereupon the at least two packaging blanks (21) are applied to a defined number and composition of articles (31) of the ordered mass flow (MS) to simultaneously or approximately simultaneously form at least two adjacent packaging units (70), wherein the applied packaging blanks (21)

are disposed, at least in part, between the articles (31) and at least partially surrounds outer lateral surfaces (36) of the article combination (30).

10. The method of claim 9, wherein the inserting step creates a distance (A), by the separating device (60), at least in an upper region, between adjacent articles (31), in the mass flow (MS), in order to dispose the folded edge regions (23) of the packaging blanks (21) between adjacent articles (31) and to apply the packaging blanks (21) to the articles (31) to form the article combination (30).

11. The method of claim 10, wherein the application die (41) further comprises lateral boundary surfaces (18) as contact surfaces for folded edge regions (23), wherein the lateral boundary surfaces (18) are capable of acting as an additional separating device for separating articles (31) of the mass flow (MS).

12. The method of claim 11, wherein the lateral boundary surfaces (18) create, a distance (A), at least in an upper region, between adjacent articles (31) in the mass flow (MS).

13. The method claim 9, wherein all four lateral edge regions (23) of a substantially rectangular packaging blank (21) are folded over to approximately 90 degrees.

14. The method of claim 13, further comprising preparing passage openings (22) of the packaging blanks (21) between the folding over step and the applying step.

15. The method of claim 14, wherein the preparing step comprises at least slightly expanding of the passage openings (22) or folding of fixing devices (25) associated with the passage openings (22).

16. The method of claim 9, wherein the folded edge regions (23) of the packaging blank (21) at least partially surround outer lateral surfaces (36) of the article combination (30).

17. A method for applying packaging (20) to an article combination (30) comprising at least two articles (31), the method comprising:

folding a packaging blank (21) at one or more folding edges (24), thereafter, applying the folded packaging blank (21) to an article combination (30) by a downward movement, wherein the packaging blank (21) applied to the articles (31) is disposed, at least in part, between the articles (31) and at least partially surrounds outer lateral surfaces (36) of the article combination (30).

18. The method of claim 17, further comprising folding over at least two opposing edge regions (23) of the packaging blank (21), wherein the folding edges (24) facilitate folding of the edge regions (23).

19. The method of claim 18, wherein the folding over of the at least two opposing edge regions (23) comprises folding over to approximately 90 degrees.

* * * * *